US006292966B1

(12) United States Patent
Lim et al.

(10) Patent No.: US 6,292,966 B1
(45) Date of Patent: Sep. 25, 2001

(54) METHOD FOR SENSING WATER LEVEL AND VIBRATION OF WASHING MACHINE AND APPARATUS THEREFOR

(75) Inventors: Hyong-Tack Lim; Hyong-Sup Kim; Sang-Ho Seo; Oh-Sung Kwon, all of Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/352,380

(22) Filed: Jul. 13, 1999

(30) Foreign Application Priority Data

Jul. 14, 1998 (KR) ..... 98-28249
Aug. 17, 1998 (KR) ..... 98-33272
Jan. 15, 1999 (KR) ..... 99-955

(51) Int. Cl.[7] ..... D06F 33/02

(52) U.S. Cl. ..... 8/158; 8/159; 68/12.05; 68/12.06; 68/12.21

(58) Field of Search ..... 8/158, 159; 68/12.04, 68/12.21, 12.16, 12.05, 12.06

(56) References Cited

U.S. PATENT DOCUMENTS 4,201,240 * 5/1980 Case .
5,301,522 * 4/1994 Ikemizu et al. .
5,325,677 * 7/1994 Payne et al. .
5,507,054 * 4/1996 Blauert et al. .
5,561,990 * 10/1996 Berkcan et al. .
5,678,268 * 10/1997 Lee .
6,029,298 * 2/2000 Dausch et al. .

FOREIGN PATENT DOCUMENTS 62-8791 * 1/1987 (JP) .
4-35685 * 2/1992 (JP) .

* cited by examiner

*Primary Examiner*—Frankie L. Stinson
(74) *Attorney, Agent, or Firm*—Birch, Stewart, Kolasch & Birch, LLP

(57) ABSTRACT

A method and apparatus for sensing the water level and vibration for a washing machine are disclosed. The method includes the steps of measuring a resonant frequency, when a water level of a washtub corresponds to the water level of zero and there is no wash within the washtub, in a water level sensor which converts the variation of water pressure according to the water level of the washtub into the resonant frequency and senses the water level as the converted resonant frequency, setting the measured resonant frequency as a reference resonant frequency, measuring the resonant frequency from the water level sensor, during a dehydration operation among washing operations, and obtaining a deviation of the measured resonant frequency from the reference resonant frequency, and comparing the deviation of the measured resonant frequency from a deviation of the reference resonant frequency to determine whether the dehydration operation is continued, for thereby achieving an optimal washing operation, wherein the method is comprised of the step of sensing the excessive vibration within the washing machine only with an output of existing water level sensor, without having a mechanical vibration sensor.

31 Claims, 10 Drawing Sheets

METHOD FOR SENSING WATER LEVEL AND VIBRATION OF WASHING MACHINE AND APPARATUS THEREFOR

BACKGROUND OF THE INVENTION

1. Field of the Invention

The present invention relates to a method for sensing a water level and vibration of a washtub for a washing machine based the amount of a laundry, and in particular, to a method and apparatus for accurately sensing a water level and vibration by detecting an abnormal vibration caused by an inclination of the laundry during a dehydration process of a washing control mode as a LC resonant frequency for thereby optimizing a washing control operation and implementing an accurate detection of a water level and vibration of a washing machine.

2. Description of the Background Art

Generally, a washing machine is designed to detect the amount of a laundry in a washtub. When the amount of the laundry is detected, the water level, the amount of a detergent, and the entire washing time are determined based on the thusly detected amount of the laundry.

Based upon the total washing time required, the washing machine executes a washing operation in which the water within the washtub swirls based on the operation of a pulsator to form a frictional force against the laundry for thereby washing the laundry.

After the washing operation, the washing machine discharges the polluted water to the outside of the washtub and then execute a rinsing operation in which a fresh water is supplied into the washtub to rinse the laundry by the preset number of times.

After the rinsing operation, the washing machine discharges the water to the outside of the washtub and then executes a dehydration operation in which an induction motor rotates at a certain high speed for thereby dehydrating the laundry based on a centrifugal separation force.

In the washing operation control of the washing machine, at an initial washing stage, the washing machine opens a water supply valve to receive a certain amount of water in accordance with the amount of the laundry within the washtub, until the water level reaches a set water level. At this time, as a water level sensing method, there is known a sensing method in which a LC resonant frequency is varied based on the pressure of water supplied within the washtub.

By way of example, if the pressure of water supplied within the washtub is varied, the LC resonant frequency is varied correspondingly thereto. Then, after the varied LC resonant frequency has been measured, the water level corresponding to the amount of the laundry is determined and the water supply valve is closed to stop the supply of water for thereby implementing a proper water level.

During the dehydration operation, since the motor is typically set to rotate at a high speed of about 1700 rotations per minute, a great centrifugal force is generated and drastically affects the laundry within the dehydration tub to thereby cause a strong vibration or noise. Meanwhile, the vibration can not be fully absorbed by means of a balancing device such as a snubber bar which is installed at an upper end portion of the washtub.

In addition, the rotation of the dehydration tub is stopped in accordance with a control of the induction motor. However, since the rotating force caused due to inertia is varied in accordance with the amount of the washing water, the rotation of the dehydration tub is temporarily decreased.

In the case that the induction motor is stopped, it is gradually increased. Accordingly, it fails to control the rotation of the dehydration tub to prevent the generation of the vibration and noises.

To overcome the above problems, an improved washing machine capable of sensing the water level and vibration within the washtub during the washing operation is disclosed.

The above improved washing machine has a water level sensor and a vibration sensor. For instance, during the washing and rinsing operations, the water level sensor serves to supply and sense the optimal water level within the washtub, and during the dehydration operation, the vibration sensor functions to sense the vibration generated in the washing machine.

FIGS. 1 to 6 illustrate a conventional washing machine in which a water level sensor and a vibration sensor are installed independently.

As shown therein, the washing machine including a water level sensor and a vibration sensor includes a tank 100 installed within a casing 102 and having an opened top portion and a closed bottom portion, a snubber bar 107 lying between dampers 108 which are respectively assembled at the upper portion of the casing 102 and the lower portion of the tank 100 for absorbing the impact of the tank 100, a washing and dehydration tub (hereinafter, called as a washtub) 101 installed in the interior of the tank 100 and mounted in a coaxial state with the tank 100 to execute the washing and dehydration operations, the washtub forming a plurality of conically shaped holes on the surface thereof, an induction motor 103 installed at a lower portion of the outer surface of the tank 100 for implementing a reverse rotation, a clutch 104 assembled with the induction motor 103 by means of a pulley belt 105 for delivering and decelerating the rotating force of the induction motor 103, a pulsator 106 rotatably installed on the inner bottom surface of the washtub 101 and interposed between the washtub 101 and the clutch 104 for swirling the water within the washtub 101, a water supply valve 109 connected with a water supply path installed at the upper portion of the tank 100 for supplying the water into the washtub 101, a water discharging valve 110 installed on the bottom surface of the tank 100 for discharging the polluted water to the outside of the washtub 101, a vibration sensor 112 installed on the inner surface of one side of the upper portion of the casing 102 for sensing the vibration formed by the contact with the tank 100 due to an eccentric rotation of the washtub 101 in accordance with an eccentrically formed laundry in a certain direction, a water pressure transfer path 113 having one end connected to the lower surface of the tank 100 and the other end vertically extended to the upper portion of the tank 100 for transferring the water pressure generated in accordance with the variation of the water level within the washtub 101, a water level sensor 111 installed at the other end of the water pressure transfer path 113 for changing and outputting an inherent inductance in accordance with the transferred water pressure, a waveform shaping unit 116 for applying a fixed capacitance to the changed value of the inherent inductance to thereby generate a resonant frequency and for then stabilizing the generated resonant frequency with a voltage waveform to thereby amplify and output the resonant frequency, and a microprocessor 114 for determining the vibration and the water level with the vibration sensed by the vibration sensor 112 and the voltage waveform inputted through the waveform shaping unit 116 and for controlling the operation of the induction motor 103 using a motor driving member 115 and the opening and closing operation of the water supply and discharging valves 109 and 110 and a valve driving member 117 in accordance with the determined vibration and the water level. FIGS. 2 and 3 illustrate the detailed configuration of the water level sensor 111 as shown in FIG. 1.

The water level sensor 111 is comprised of a cylindrical housing 10 which has a through hole connected through the water pressure transfer path 113 to the tank 100 at one side thereof and an opening hole at the other side thereof, a bellows 11 which is installed within the housing 10 and is connected to the water pressure transfer path 113 to be extended or expanded in accordance with the pressure of water within the washtub 101, a shielding member 12 which is sealed at the top portion of the bellows 11 and have a hook shape to shield the water pressure, a cylindrical coil 14 having an inherent inductance value, which is installed at the center portion of the inner wall of the housing 10 to be separated by a predetermined distance in a vertical direction from the shielding member 12, a cylindrical core 13 which is hooked at the upper portion of the shielding member 12 and moves vertically in the internal space of the coil 14 in accordance with the extension and expansion of the bellows 11 to thereby vary the inherent inductance value of the coil 14, a cylindrical support member 16 which is assembled at the top end portion of the coil 14 and serves to support the coil 14 against the housing 10, a cap 17 which is adapted to cover the opening at the top end portion of the support member 16, and a coil shape spring 15 which is interposed between the top surface of the core 13 and the bottom surface of the cap 17 to restore the core 13 to the original position thereof.

The waveform shaping unit 116, as shown in FIG. 6, is comprised of an amplifier 116*a* which amplifies an input voltage to a substantial voltage size to provide the amplified voltage to the microprocessor 114, and condensers C1 and C2 which are respectively connected in serial with the input and output terminals of the amplifier 116*a* via resistors R1 and R2 and feed back the output voltage from the amplifier 116*a* to the input voltage thereof. In this case, the waveform shaping unit 116 is operated based on a LC resonant circuit configuration in such a manner that both terminals a and b of the coil 14 are respectively connected in parallel with the condensers C1 and C2, and the core 13 moves vertically in the internal space of the coil 14.

The vibration sensor 112 such as a safety switch or a limit switch, as shown in FIG. 5, is comprised of first and second voltage discontinuous members 22 and 23 which are respectively installed at the upper portion of the casing 102 and is electrically short-circuited or opened, a switch leg 20 which is hinged to the first voltage discontinuous member 22 to be separated at a predetermined distance from the tank 100 and rotates by the striking of the tank 100 according to the rotation radius of the washtub 101 to electrically short-circuit the first and second voltage discontinuous members 22 and 23, and a spring 21 which restores the switch leg 20 to the original position thereof to electrically open the first and second voltage discontinuous members 22 and 23. An explanation of the operation of the conventional washing machine in which the water level sensor and the vibration sensor are installed, respectively will be discussed in detail with reference to FIGS. 1 to 6.

Firstly, if an operation is started after the washing operation has been set through an operational panel (not shown), the microprocessor 114 controls the water supply valve 109, the water discharging valve 110 and the induction motor 103 through the valve driving member 117 and the motor driving member 115 to thereby execute the washing, rinsing and dehydration operations in a scheduled sequence.

At this time, the microprocessor 114 receives an input signal, which is generated in accordance with the operation states of the water level sensor 111 sensing the water level of the washtub 101 and the vibration sensor 112 sensing the vibration of the washtub 101, and then outputs a control signal in response to the input signal.

In this case, the microprocessor 114 meets the following conditions. It recognizes the state where the core 13 of the water level sensor 111, as will be described in detail, is not advanced into the internal space of the coil 14, as the state where the water is not retained within the washtub 101, i.e. the water level of zero, and contrarily, recognizes the state where the core 13 of the water level sensor 111 moves vertically the internal space of the coil 14, as the state where the water is retained within the washtub 101 based upon the movement of the core 13.

Under the above conditions, the microprocessor 114 controls, for the purpose of supplying the water within the washtub 101 upon an initial washing operation, the valve driving member 117 to open the water feeding valve 109 such as an electronic control valve in accordance with the amount of the laundry retained within the washtub 101.

If the water is fed into the washtub 101, the water pressure becomes high. Then, the water pressure is applied, through the water pressure transfer path 113 connected to the tank 100, to the bellows 11 within the housing 10 of the water level sensor 111. At this time, the shielding member 12, which is sealed at the upper portion of the bellows 11, prevents the water pressure from being continuously increased. This results in the generation of pressure expansion. Thereby, the pressure expansion renders the bellows 11 expanded in proportion to the water pressure.

Referring to FIG. 4, if the bellows 11 is expanded, the cylindrical core 13, which is assembled with the shielding member 12, moves in the internal space of the coil 14 upwardly in the vertical direction, in step ST10. The coil 14 has a diameter larger than that of the core 13 and includes the inherent inductance value. The inherent inductance value is varied in accordance with the upward movement of the core 13, in step ST20. For example, the inherent inductance value is increased as the core 13 moves in the internal space of the coil 14 in the upward direction.

The inductance variation value of the coil 14 is multiplied by a capacitance value of the condensers C1 and C2 of the waveform shaping unit 116 of FIG. 6 to be produced as a predetermined resonant frequency. The resonant frequency is shaped into a voltage waveform by the waveform shaping unit 116 and is then supplied to the microprocessor 114.

In other words, the both terminals a and b of the coil 14 of the water level sensor 111 are respectively connected in parallel with the condensers C1 and C2 of the waveform shaping unit 116. As a result, the waveform shaping unit 116 is operated based on a single LC resonant circuit configuration by the arrangement of the coil 14 and the condensers C1 and C2, thus to generate the resonant frequency, at step ST30.

Conventionally, the resonant frequency $f_0$ of the LC resonant circuit is calculated under the following equation:

$$f_0 = \frac{1}{2\pi\sqrt{LC}} \text{ [Hz]}$$

The resonant frequency $f_0$ is amplified by the amplifier 116*a* to a substantial voltage size, and the amplified voltage waveform is provided to the microprocessor 114.

The microprocessor 114 measures the water level within the washtub 101 on the basis of the resonant frequency $f_0$ of the waveform shaping unit 116 generated based on the inductance variation value of the water level sensor 111. Then, it determines as to whether the measured water level is optimal to correspond with the amount of the laundry detected. If determined as optimal, it controls the valve driving member 117 to close the water supply valve 107.

Thereafter, it controls the motor driving member 115 to alternatively electrify the induction motor 103, which renders the pulsator 106 to be forwardly and reversely rotated in turn.

As a result, the water within the washtub 101 is swirled, which causes the frictional force against the laundry to be generated, thus to execute the washing operation.

If the washing operation is completed, the microprocessor 114 controls the valve driving member 117 to open the water discharging valve 110 and discharges the polluted water to the outside of the washtub 101. At the time, the water level sensor 111 senses whether the polluted water within the washtub 101 is completely discharged.

In other words, during the discharging operation, the water pressure is decreased as the water level within the washtub 101 is low. Accordingly, if the water pressure is increasingly decreased, the bellows 11 is expanded, based upon the elastic force of the spring 15, which is interposed between the cap 17 and the core 13 of the water level sensor 111. Moreover, the core 13 gradually descends vertically in the internal space of the coil 14, thereby returning to the initial position thereof.

If the core 13 is returned to the initial position thereof, the inductance value of the coil 14 is also decreased. Hence, the resonant frequency $f_0$, which is obtained by multiplying the inductance variation value of the coil 14 by the capacitance value of the condensers C1 and C2, is changed to the initial value thereof and then inputted to the microprocessor 114. As a result, the microprocessor 114 determines the completion time of the discharging operation.

After the completion of the washing operation, the rinsing operation is implemented through the water feeding and discharging to/from the washtub 101, as mentioned above.

For the dehydration operation after the washing and rinsing operations are performed, the microprocessor 114 controls the induction motor 103 to be rotated at a set rotation speed and senses the vibration generated within the washtub 101 due to the rotation of the induction motor 103 by means of the vibration sensor 112 as shown in FIG. 5.

During the dehydration operation, an appropriate balance or an undesirable vibration within the tank 100 is generated in accordance with the collection of the laundry in a certain direction.

If the laundry is uniformly disposed at the internal wall of the washtub 101, the vibration within the washtub 101 caused due to the rotation speed of the induction motor 103 is not generated after a little amount of vibration has been generated. As a result, the washtub 101 finally reaches a normal dehydration speed, while having the same rotation radius centering around the concentric axis. This creates a balancing state where no vibration within the tank 100 is generated, thus to execute the normal dehydration operation during the set time period.

On the other hand, if the laundry is inclined at a certain corner of the wall of the washtub 101, the washtub 101 eccentrically rotates in every direction as the rotation speed is high, and if the eccentric rotation is severe, the tank 100 undesirably strikes against the washtub 101.

The vibration width is increased in accordance with the strength of the striking at the tank 100, and as shown in FIG. 5, the switch leg 20 of the vibration sensor 112 such as the safety switch or the limit switch is struck at every rotation. Thereby, the switch leg 20 electrically short-circuits or opens the first and second voltage discontinuous members 22 and 23, while rotating counterclockwise or clockwise by means of the spring 21.

If the microprocessor 114 inputs an electrical signal from any one of the first and second voltage discontinuous members 22 and 23, it controls the water supply valve 109 to supply the water within the washtub 101 and thus executes an untwisting operation for the laundry during a predetermined time period. Thereby, the laundry can be uniformly disposed on the wall surface of the washtub 101 to thereby reduce the strength of the vibration formed.

If the vibration is decreased, the microprocessor 114 controls the motor driving member 115 to rotate the induction motor 103 at a high speed, thereby completing the dehydration operation.

Meanwhile, if the microprocessor 114 continuously inputs the electrical signal from the corresponding voltage discontinuous member, after the untwisting operation for the wash, it halts the induction motor 103 to thereby prevent the generation of the over-vibration.

It can be appreciated that the water level and vibration sensing device in the conventional washing machine is capable of sensing, during the washing operation for the wash, the water level of the washtub using the LC resonant circuit in which an inductance variation value of the coil within the water level sensor is calculated and sensing, during the dehydration operation for the wash, the vibration within the washtub using the separate vibration senor such as a limit switch.

As known, however, since the conventional washing machine should include independent water level sensor and vibration sensor, there are some problems in that the production cost is high and a manufacturing process is complicate.

In addition, since the vibration sensor uses mechanical contact points and a spring, there is a problem in that malfunctions may be generated due to the aged deterioration or corrosion of the contact points. Furthermore, it is impossible for the conventional vibration sensor to accurately sense the vibration within the washtub because of the necessity of the adjustment of the intervals of the contact points and the decrement of the restoring force of the spring.

By way of example, if the vibration sensor is installed adjacent to the tank, it senses a slight vibration of the tank, which causes the washing machine to execute an unnecessary operation. However, if installed at some distance, it does not sense the vibration until the vibration becomes severe. Therefore, so as to dispose the initial position of the vibration sensor in an accurate manner, an additional production cost should be required and a productivity efficiency may be degraded.

Accordingly, there is a need to provide an improved water level and vibration sensing device which can solve the above problems experienced in the conventional washing machine and cam be manufactured with relative low production cost and high reliability.

SUMMARY OF THE INVENTION

Accordingly, the present invention is directed to a method and apparatus for sensing the water level and vibration in a washing machine that substantially obviates one or more of the problems due to limitations and disadvantages of the related arts.

An object of the invention is to provide a method and apparatus for sensing the water level and vibration in a washing machine which installs a unitary sensor to accurately sense both the water level and the vibration, thereby achieving an optimal washing operation, wherein the method is comprised of the step of sensing the excessive vibration within the washing machine only with an output of existing water level sensor, without having a mechanical vibration sensor.

Another object of the invention is to provide a method and apparatus for sensing the water level and vibration in a washing machine in which an active control in washing and dehydration operations is made by monitoring and suppressing the vibration state and the water level of the washtub therein, wherein the apparatus is comprised of a unitary sensor which is miniaturized and simply configured to accurately sense both the water level and the vibration of the washtub.

Still another object of the invention is to provide a method and apparatus for sensing the water level and vibration in a washing machine which can measure the vibration of a washtub, not in one-way direction, but in three-dimensions, to suppress a vibration error rate and can install control members for measuring the vibration in three-dimensions, while maintaining existing water level sensor function.

According to an aspect of the present invention, there is provided a method for sensing the water level and vibration in a washing machine which comprises the steps of measuring a resonant frequency, when a water level of a washtub corresponds to the water level of zero and there is no wash within the washtub, in a water level sensor which converts the variation of water pressure according to the water level of the washtub into the resonant frequency and senses the water level as the converted resonant frequency, setting the measured resonant frequency as a reference resonant frequency, measuring the resonant frequency from the water level sensor, during a dehydration operation among washing operations, and obtaining a deviation of the measured resonant frequency from the reference resonant frequency, and comparing the deviation of the measured resonant frequency from a deviation of the reference resonant frequency to determine whether the dehydration operation is continued.

According to another aspect of the present invention, there is provided a method for sensing the water level and vibration in a washing machine comprises the steps of moving the internal space of a coil by the variation of water pressure according to the water level of a washtub, during a washing operation, to vary an inherent inductance of the coil, moving the internal space of the coil by the vibration in a horizontal direction according to an eccentric rotation of the washtub, during a dehydration operation, to vary the inherent inductance of the coil, adding a predetermined capacitance value to the inherent inductance variation value, to thereby vary a resonant frequency, and determining the water level and the vibration within the washtub, on the basis of the variation amount of the resonant frequency.

Preferably, the amount of variation of the inherent inductance of the coil is defined as $\Delta L1$, during the washing operation and as $\Delta L2$, during the dehydration operation, under the conditions $\Delta L1 > \Delta L2$.

According to still another aspect of the present invention, there is provided a method for sensing the water level and vibration in a washing machine comprises the steps of moving the internal space of a coil by the variation of water pressure according to the water level of a washtub, the coil having at least two or more inherent inductance values, to thereby vary any one inherent inductance value of the coil, freely moving a sliding member centering around a support member in which variation area and non-variation area are divided, according to an eccentric rotation of the washtub, to thereby vary at least one or more inherent inductance of the coil including the inherent inductance value for movement in a vertical direction, adding a predetermined capacitance value to the varied inherent inductance variation value, to thereby vary an inherent resonant frequency, and determining the water level and the vibration within the washtub, on the basis of the variation amount of the resonant frequency.

Preferably, the non-variation area is occupied by the portion to which the center of the support member is adjacent, and the variation area is occupied by the portion from which the center of the support member is far. In this case, as the sliding member moves toward the variation area, the inherent inductance value of the coil gradually increases.

Assuming that the left and right directions relative to a concentric axis of the washtub is designated as 'X', the before and behind directions as 'Y', and the top and bottom directions as 'Z', preferably, the coil has the inherent inductance value in the directions X, Y and Z, respectively.

It is desirable that any one of the directions X, Y and Z of the coil is designated as a water level sensing direction and the other as a vibration sensing direction.

Assuming that the vibration in the directions X, Y and Z is denoted as Vx, Vy and Vz, and the inherent inductance values in each direction are as Lx, Ly and Lz, the vibration in each direction is given by the following expressions: $Vx=f1\ (Lx, Lz)$, $Vy=f2\ (Ly, Lz)$, and $Vz=f3\ (Vz)$, where coefficients f1, f2 and f3 are optional functions.

According to yet another aspect of the present invention, there is provided an apparatus for sensing the water level and vibration in a washing machine which comprises a sealing state maintaining member installed within a housing connected via a water pressure transfer path to a tank and moving vertically due to the variation of water pressure according to a water level of a washtub, a substantially cylindrical coil unit installed in the center portion of the internal wall of the housing and having an inherent inductance value, a magnetic media assembled on the upper surface of the sealing state maintaining member and moving vertically the internal space of the coil unit according to the variation of the water pressure to thereby vary the inherent inductance value of the coil unit, an inclined support member by a predetermined angle disposed to be separated by a predetermined distance from the top end portion of the magnetic media on the internal space of the coil unit and moving vertically according to the variation of the water pressure, along with the magnetic media, a sliding member made of a predetermined material, having a predetermined diameter, and moving vertically along the inclined surface of the support member according to an eccentric rotation of the washtub, to thereby vary the inherent inductance value of the coil unit, and a waveform shaping unit for adding a predetermined capacitance value to the varied inherent inductance variation value of the coil unit to thereby generate a resonant frequency and stabilizing the resonant frequency in a voltage waveform to selectively measure the amounts of water level and eccentricity in each direction.

According to yet still aspect of the present invention, there is provided an apparatus for sensing the water level and vibration in a washing machine which comprises a sealing state maintaining member installed within a housing connected via a water pressure transfer path to a tank and expanding and moving vertically due to the variation of water pressure according to a water level of a washtub, a coil unit installed at the center portion of the internal wall of the housing and having at least two or one inherent inductance values, a magnetic media hook-assembled on the upper surface of the sealing state maintaining member and moving vertically the internal space of the coil unit according to the variation of the water pressure to thereby vary any one of the inherent inductance values of the coil unit, a support member disposed to be separated by a predetermined distance from the top end portion of the magnetic media on the internal space of the coil unit and moving vertically according to the variation of the water pressure, along with the magnetic media, the support member having the upper surface on which a variation area and a non-variation area are divided on the basis of the center portion thereof, a sliding member made of a predetermined material, having a predetermined diameter, and moving freely to the variation area and the non-variation area of the support member according to an eccentric rotation of the washtub, to thereby vary any one of the inherent inductance values of the coil unit, and a waveform shaping unit for adding a predetermined capacitance value to the varied inherent inductance variation value of the coil unit to thereby generate a resonant frequency and stabilizing the resonant frequency in a voltage waveform to selectively measure the amounts of water level and eccentricity in each direction.

Assuming that the left and right directions relative to a concentric axis of the washtub is designated as 'X', the before and behind directions as 'Y', and the top and bottom directions as 'Z', preferably, the coil unit takes a substantially square hexahedral shape and is comprised of a coil which winds horizontally in the directions X, Y and Z, respectively, on the square hexahedron in a predetermined winding ratio.

Preferably, any one of the coils in the directions X, Y and Z varies the inductance value by the water level and vibration, and the other coils vary the inductance values according to the amount of eccentricity of the washtub, together with the one coil.

The upper surface of the support member is formed to have the portions in the left and right directions inclined to have the same angle as each other, on the center portion thereof, to thereby sense the eccentricity in the direction of X in the washtub, where the inclined angle is 20 degrees.

Preferably, the upper surface of the support member is rounded to have a smooth inclined surface in a radial direction, on the center portion thereof, to thereby form a spherical inner rounded surface, on which the sliding member moves freely in the radial direction.

Assuming that the vibration in the directions X, Y and Z is denoted as Vx, Vy and Vz, and the inherent inductance values in each direction are as Lx, Ly and Lz, the vibration in each direction is given by the following expressions: Vx=f1 (Lx, Lz), Vy=f2 (Ly, Lz), and Vz=f3 (Vz), where coefficients f1, f2 and f3 are optional functions.

It can be from the above description understood that the unitary sensor according to the present invention can sense, during the washing and dehydration operations, both the water level of the washtub and an amount of vibration according to the eccentric rotation of the washtub.

As a result, a method and apparatus for sensing the water level and vibration in a washing machine according to the preferred embodiments of the present invention has the following advantages: a) a precise measuring result for the water level and vibration within the washtub can be extracted; b) an error probability of the vibration sensing value and a time period required for the dehydration can be all reduced; and c) installation of a mechanical vibration sensor is not needed.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 16A and 16B illustrate graph diagrams in which a method for sensing the water level and vibration in a washing machine according to a fourth embodiment of the present invention is applied to FIGS. 2, 3 and 6, wherein FIG. 16A is a graph diagram illustrating a resonant frequency measurement result during a no-load dehydration and FIG. 16B is a graph diagram illustrating a resonant frequency measurement result in case of a large amount of the wash.

DETAILED DESCRIPTION OF THE PREFERRED EMBODIMENTS

Figure 1:
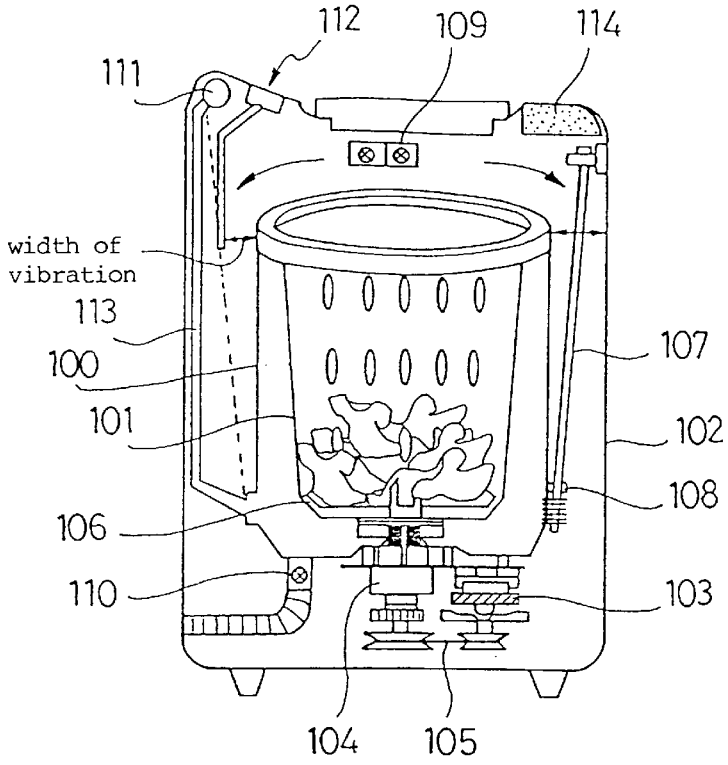
FIG. 1 illustrates a side view of a schematic configuration of a conventional washing machine in which a water level sensor and a vibration sensor are installed independently of each other.

Reference will now be made in detail to the preferred embodiments of the present invention, examples of which are illustrated in the accompanying drawings.

The present invention includes, of course, a plurality of embodiments, but hereinafter, an explanation on some preferred embodiments of the present invention will be in detail discussed.

In the drawings, like numbers indicate the same or similar elements and an explanation of them will be excluded in this detailed description for the sake of brevity.

Figure 7:
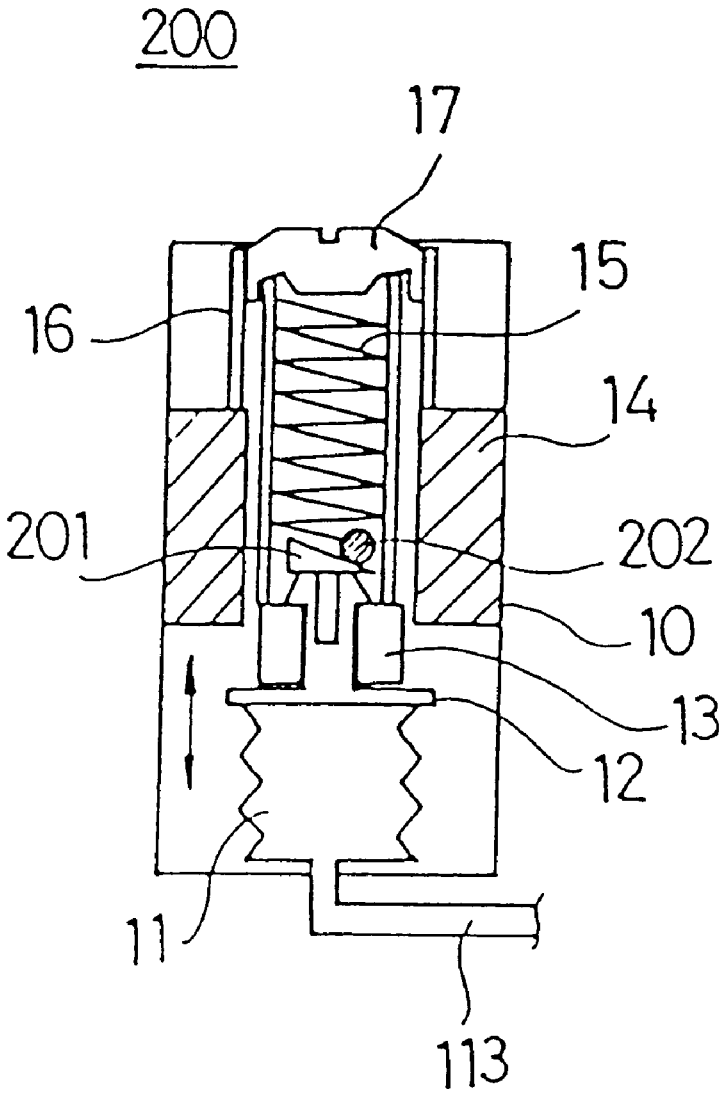
FIG. 7 illustrates a sectional view taken in a vertical direction of a unitary water level and vibration sensor in a washing machine according to a first embodiment of the present invention.
Figure 8:
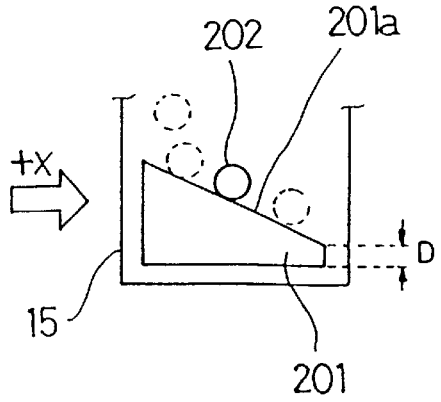
FIG. 8 illustrates an enlarged sectional view of a first support member of FIG. 7, in which a first sliding member moves in every direction according to the left and right impact of the tank and thus senses the vibration within the tank.

FIG. 7 illustrates a sectional view taken in a vertical direction of a unitary water level and vibration sensor in a washing machine according to a first embodiment of the present invention, and FIG. 8 illustrates an enlarged sectional view of a first support member of FIG. 7, in which a first sliding member moves in every direction according to the left impact of the washing machine and thus senses the vibration therein.

Figure 6:
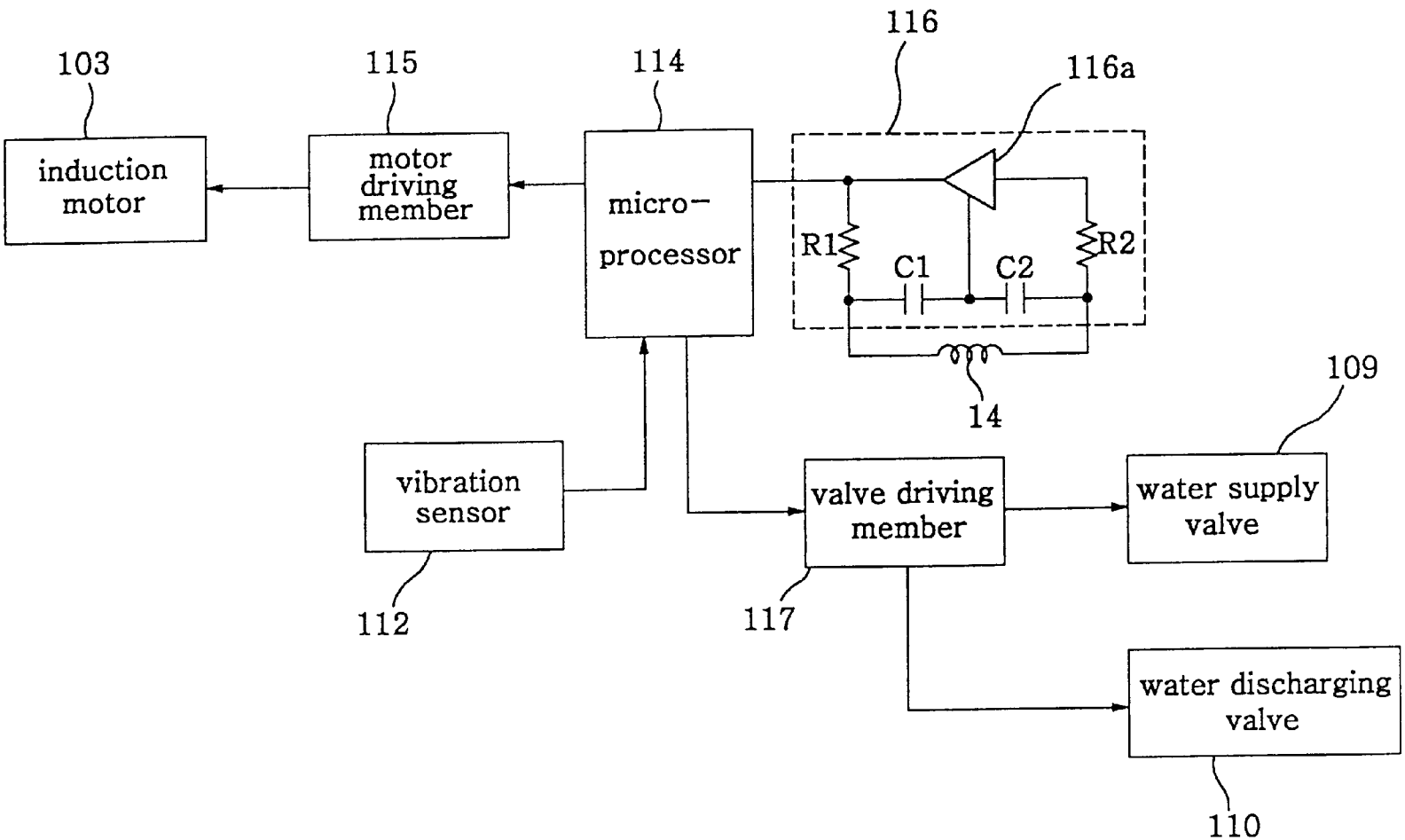
FIG. 6 illustrates a block diagram of a system for controlling a washing operation in accordance with the action of the water level sensor and the vibration sensor in FIG.

In the first embodiment of the present invention, a water level and vibration sensor 200 includes a cylindrical housing 10 perpendicularly installed at an outer wall of a casing and engaged via a tank 100 and a water pressure transfer path 113, a bellows 11 installed in the housing 10, connected with the water level transfer path 113, and retracted and elongated in accordance with a variation of the water pressure based on the water level in the washtub 101, a shielding member 12 shielded at an upper portion of the bellows 11 and having a hook shape for shielding the transfer of the water pressure, a circular coil 14 having a certain inductance and installed at an inner wall of the housing 10, a cylindrical core 13 hooked to the upper surface of the shielding member 12 and vertically moving in the interior of the coil 14 in accordance with a retracting is and elongating operation of the bellows 11 for varying a certain inductance of the coil 14, a cylindrical support member 16 engaged to an upper portion of the coil 14 for supporting the coil to the housing 10, a cap 17 for capping an open portion of the support member 16, a coil shape spring 15 vertically engaged at an upper surface of the core 13 and a lower surface of the cap 17 for returning the position of the core 13 to its original position, a first support member 201 installed in the interior of the coil 14 at a certain distance from the upper portion of the core 13, vertically moving together with the core 13 based on the retracting and elongating operation of the bellows 11 and having its upper surface having an inclination 201*a*, and a first sliding member 202 having a diameter of about 3 mm through 5 mm, horizontally and vertically moving along the inclination surface 201*a* of the first support member 201 by an eccentric rotation of the washtub 101 and varying the inductance of the coil 14. Both terminals a and b of the coil 14 are parallely connected between the condensers C1 and C2 as shown in FIG. 6, so that a waveform shaping unit 116 operates as a LC resonant circuit when the core 13 and the first sliding member 202 vertically move in the interior of the coil 14 and along the inclination surface 201*a* of the first support member 201.

The water level and vibration sensing apparatus according to the first embodiment of the present invention operates as follows with respect to the detection of the vibration level due to the water level and an inclination of the laundry without a sensing error during a washing and dehydration process in the washing control operation.

The first embodiment of the present invention will be explained in more detail with reference to the accompanying drawings.

First, when a washing process, a rinsing process, and a dehydration process are set using an operation panel (not shown), the microprocessor 114 controls the water supply valve 109, the dehydration valve 110, and the induction motor 103 based on the valve driving unit 117 and the motor driving unit 115 for thereby implementing the set washing, rinsing and dehydration processes. At this time, at an initial stage of the washing process, the microprocessor 114 opens the water supply valve 109 using the valve driving unit 117 based on the amount of the laundry in the washtub 101 and supplies water into the washtub 101.

When water is supplied into the washtub 101, the water pressure is applied to a certain shielding state maintaining unit such as the bellows 11 installed in the housing 10 via the water pressure transfer path 113 connected with the tank 100.

At this time, the transfer of the water pressure is blocked by the shielding member 12 which shields the upper portion of the bellows 11. In this state, the bellows 11 is elongated in proportion to the water pressure.

When the bellows 11 is elongated, namely, the bellows 11 is upwardly moved, the magnetic medium such as a cylindrical core 13 hooked to the shielding member 12 and the first support member 201 are vertically moved in the interior of the coil 14. At this time, the first sliding member 202 which is formed of a magnetic material is not vertically moved in the leftward and rightward directions along the inclination surface 201*a* of the first support member 201 but vertically moved in a state that the same is positioned at the rightward portion of the first support member 201 as shown in FIG. 8. Here, the inductance variation of the coil 14 based on the vertical movement of the first support member 201 is neglected. Namely, the inductance of the coil 14 is varied based on the vertical moving distance of the core 13. As the core 13 is moved in the upward direction in the interior of the coil 14, the inductance value of the coil 14 is increased.

The inductance variation value of the coil 14 is multiplied by the capacitances C of the condensers C1 and C2 of the waveform shaping unit 116 as shown in FIG. 6 and is generated as a certain resonant frequency. The thusly varied resonant frequency is amplified to a certain level by an amplification device 116*a* of the waveform shaping unit 116 and is provided to the microprocessor 114.

Since both terminals a and b of the coil 14 are parallely connected between the condensers C1 and C2 of the waveform shaping unit 116, the waveform shaping unit 116 operates as a LC resonant circuit by the coil 14 and the condensers C1 and C2 for thereby generating a resonant frequency.

The microprocessor 114 compares the variation value of the resonant frequency inputted from the LC resonant circuit with a water level variation for thereby judging the water level of the washing tub 101. If the judged water level is the optimum water level corresponding to the sensed amount of the laundry, the water supply valve 109 is closed by the valve driving unit 117, and the washing process is performed.

When the washing process is completed, the dehydration valve 110 is opened by the valve driving unit 117 for thereby discharging a polluted water from the washtub 101.

In the water draining mode, as the water level is decreased in the washtub 101, the water pressure is decreased. When the water pressure is gradually decreased, the bellows 11 is retracted by an elastic force of the coil shape spring 15 engaged between the magnetic medium such as the cap 17 and the core 13, and the core 13 and the first support member 201 are vertically and downwardly moved in the interior of the coil 14.

When the core 13 and the first support member 201 are returned to their original positions, the inductance of the coil 14 is decreased. The resonant frequency based on the decreased inductance and the capacitances of the condensers C1 and C2 are changed to the initial values and are inputted into the microprocessor 114 for thereby judging the completion time of the water draining process.

When the washing process is completed, the rinsing process is performed after the water supply and draining processes are performed based on the water level sensing method.

After the washing and rinsing processes are performed, the microprocessor 114 operates the inductance motor 103 at a high speed for thereby performing a dehydration process.

In the dehydration process, since the water level of the washtub 101 is a zero level, the water pressure applied to the water level sensor becomes the resonant frequency at the time when the water level is zero.

In addition, in the dehydration process, when the laundry is uniformly arranged in the washtub 101, the washtub 101 is uniformly rotated with respect to the co-axis, so that an optimized operation is implemented without vibration of the tank 100.

When the tank 100 is in the balanced state without vibration, as shown in FIG. 8, the first sliding member 202 such as a ball formed of a magnetic material is not moved in the leftward and rightward directions along the inclination surface 201*a* of the first support member 201. Namely, the same is positioned at the rightward portion of the inclination surface 201*a*.

When the first sliding member 202 which is formed of a magnetic material is positioned at the rightward portion of the first support member 201, the inductance of the coil 14 is not varied. Therefore, the same resonant frequency is generated from the LC resonant circuit and is provided to the microprocessor.

The microprocessor 114 recognizes the balanced state of the tank 100 using a voltage wave form with respect to the continuously inputted same resonant frequency and accelerates the inductance motor 103 using the motor driving unit 115 during a certain dehydration time for thereby dehydrating the laundry in the washtub 101.

If the laundry is inclined at a certain wall of the washtub 101, the washtub 101 is eccentrically rotated, and the tank 100 is unbalanced based on the eccentric rotation, so that the tank 100 is vibrated in the every direction.

When the tank 100 is vibrated, as the first sliding member 202 formed of a magnetic material having a diameter of 3 mm through 5 mm is moved, the upper surface of the first support member 201 is moved in the leftward and rightward directions along the inclination surface 201*a* at an angle range of 0° through 40°, namely, in the ±X directions and the vertical ±Z direction.

For example, as shown in FIG. 8, if a certain force (vibration) is applied in the leftward direction, the first sliding member 202 is moved in the −X direction along the inclination surface 201*a* of the first support member 201 by a reaction operation and is moved in the +Z direction. Namely, the first sliding member 202 is moved in the vertical direction (+Z) direction in accordance with the inclination angle of the first support member 201. Here, the diameter of the first sliding member 202 is about 4 mm, and the inclination angle of the first support member 201 is 20°. The height D from the lower surface of the first support member 201 to an initial position of the inclination angle is about 0 mm.

Continuously, when the first sliding member 202 is moved in the horizontal and vertical directions along the inclination surface 201*a* of the first support member 201 in accordance with the vibration of the tank 100, the inductance of the coil 14 is changed.

When the tank 100 is greatly vibrated, the first sliding member 202 is greatly moved in the vertical direction along the inclination surface 201*a*, and then is fallen by the gravity. Therefore, the inductance of the coil 14 is greatly changed. As a result, the resonant frequency of the LC resonant circuit is changed and is inputted into the microprocessor 114.

Therefore, the microprocessor 114 detects the vibration of the tank caused by the eccentric rotation of the washtub 101 using the water level and vibration sensor 200, and the rinsing and dehydration processes are performed in the above-described manner.

In the washing process, assuming that the inductance variation of the coil 14 due to the water level variation of the washtub 101 is Δ1, and the inductance variation of the coil 14 due to the vibration of the washtub 101 is ΔL2, the variation level of the inductance is ΔL1 >ΔL2.

In the washing process, since the vertical direction movement distance that the core 13 is moved in the coil 14 by the pressure of the water supplied based on the amount of the laundry in the washtub 101 is great, the inductance of the coil 14 is greatly changed. In the dehydration process, the vibration is most greatly generated. The first sliding member 202 is moved as long as the length of the inclination surface 201*a* of the first support member 201. The variation of the inductance of the coil 14 is smaller than the movement of the core 13.

Figure 9:
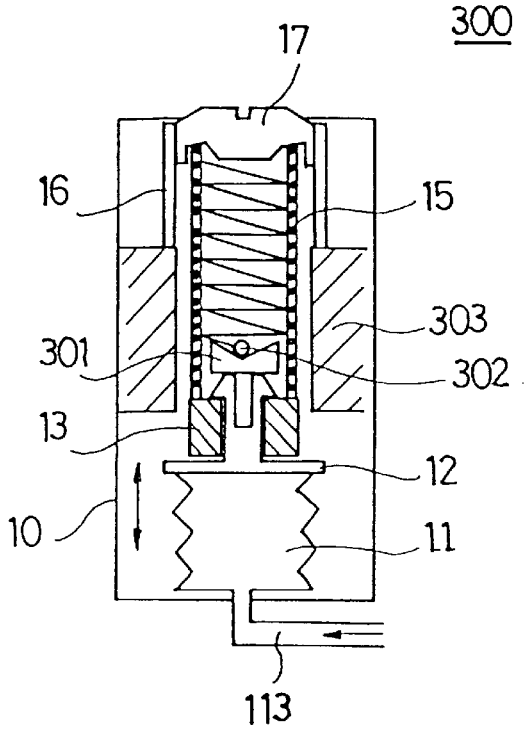
FIG. 9 illustrates a sectional view taken in a vertical direction of a unitary water level and vibration sensor in a washing machine according to a second embodiment of the present invention.
Figure 10:
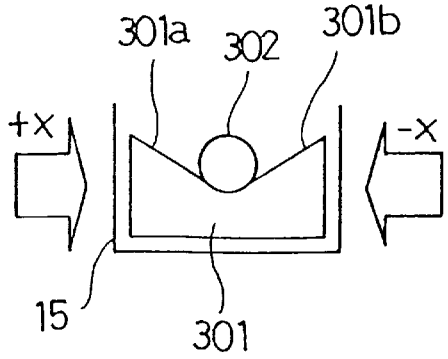
FIG. 10 illustrates an enlarged sectional view of a second support member of FIG. 9, in which a second sliding member moves in every direction according to the left and right impact of the tank and thus senses the vibration within the tank.
Figure 13:
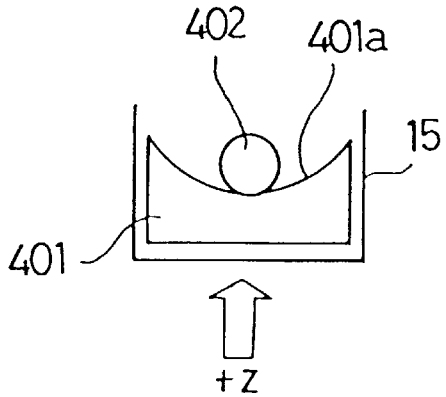
FIG. 13 illustrates a sectional view taken in a line I—I of FIG. 12.

FIGS. 9, 10 and 13 illustrate the second embodiment of the present invention.

The water level and vibration sensor 300 according to the second embodiment of the present invention includes a cylindrical housing 10 vertically installed at an outer wall of the upper portion of the casing 102 and connected via the tank 100 and the water pressure transfer path 113, a bellows 11 installed in the housing and connected with the water pressure transfer 113 and implementing a retraction and elongation movement by the water pressure based on the water level in the washtub 101, a shielding member 12 having a hook shape and shielding the transfer of the water pressure at the upper portion of the bellows, a coil unit 303 for installed at an inner center portion of the housing 10 and having more than at least three inductances, a cylindrical core 13 which is hooked at the upper portion of the shielding member 12 and is vertically moved in the inner space of the coil unit 303 in accordance with a retracting and elongating operation of the bellows 11 and varies an inductance of the coil unit 303, a cylindrical support member 16 engaged to the upper portion of the coil unit 303 and supporting the coil unit, a cap 17 for covering the upper open portion of the support member, a spring 15 vertically engaged on the upper surface of the core 13 and the lower surface of the cap 17 and being formed in a spring shape for returning the core 13 to its original position, a second support member 301 installed in the inner space of the coil unit 303 spaced apart from the upper portion of the core 13 and vertically moving together with the core 13 based on the retracting and elongating operation of the bellows 11 and having its inclination surfaces 301*a* and 301*b*, a second sliding member 302 having a diameter of amount 3 mm through 5 mm and vertically moving along the inclination surfaces 301*a* and 301*b* at the center portion of the upper surface of the second support member 301 by the eccentric rotation of the washtub 101 and varying an inductance of the coil unit 303 and being formed of a magnetic material, and a waveform shaping unit 304 for providing a fixed capacitance to the inductance of the coil unit 303 based on the vertical movement of the core 13 and the movement of the second sliding member 302, generating a resonant frequency, and stabilizing and outputting the resonant frequency to a voltage waveform.

Figure 14:
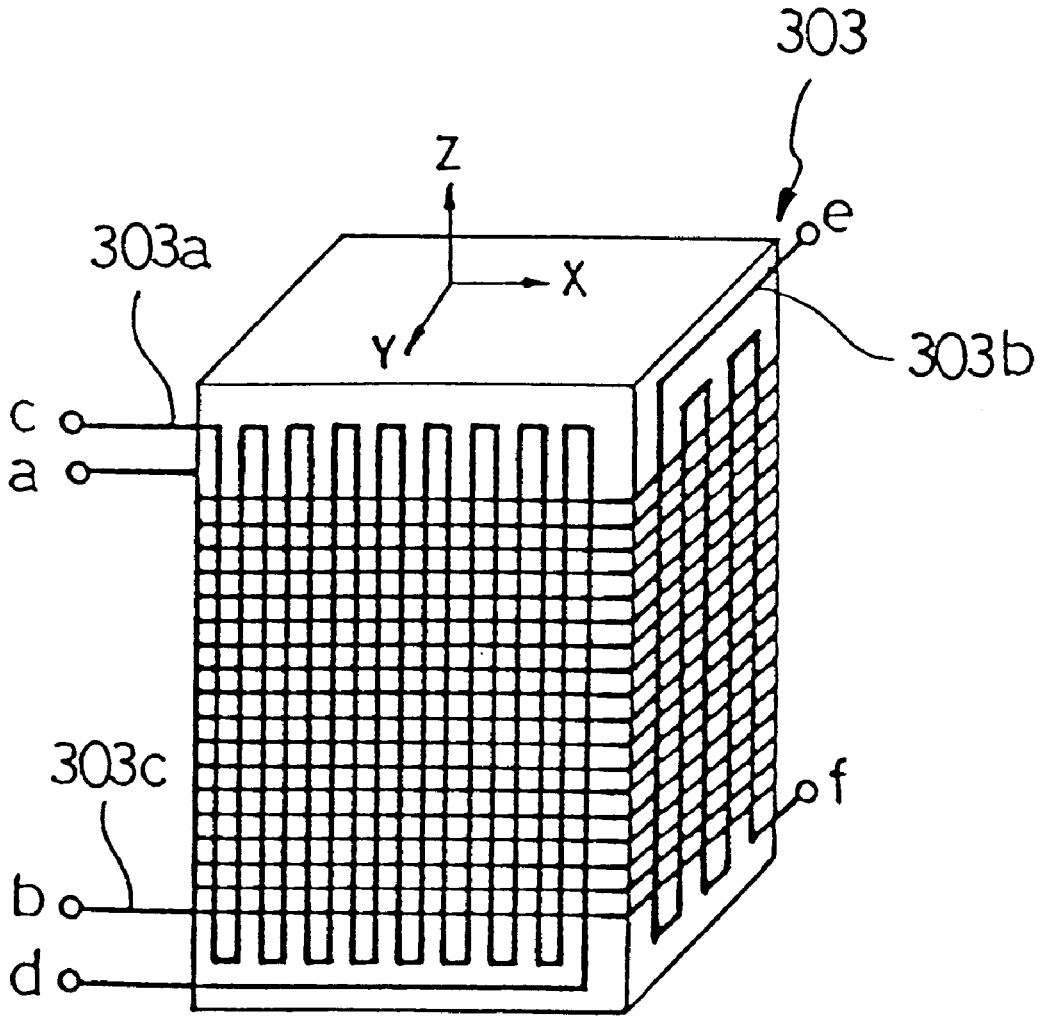
FIG. 14 illustrates an enlarged view of a coil embodied in the second and third embodiments of the present invention.

FIG. 14 illustrates the construction of the coil unit 303 according to the second embodiment of the present invention.

The coil unit 303 is formed in a cubic shape and includes coils 303*a* through 303*c* which are wound in the X, Y and Z directions.

Namely, The coils 303*a* and 303*b* are wound in the X and Y direction, and the coil 303*c* is wound in the Z direction into or onto the coils 303*a* and 303 *b*.

The Z-direction coil 303*c* is directed to detecting the vertical movement of the core 13 based on the water level, and the X and Y direction coils 303*a* and 303*b* are directed to detecting the current position of the second sliding member 302 based on the two-dimensional manner.

Figure 15:
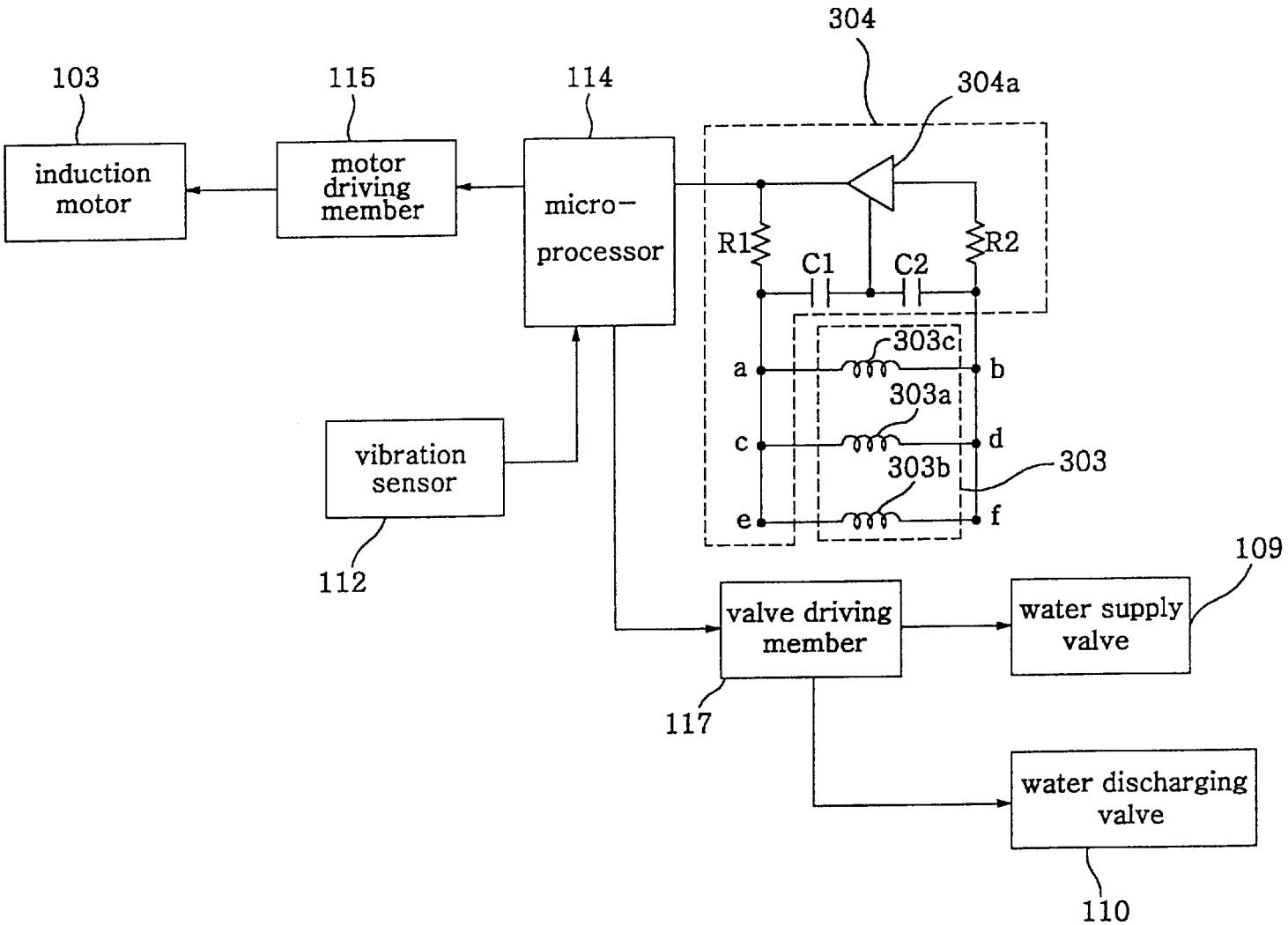
FIG. 15 illustrates a block diagram of a system for controlling a washing operation by sensing both the water level and the vibration at one time through an inductance variation value of the coil embodied in the second and third embodiments of the present invention.

As shown in FIG. 15, the waveform shaping unit 304 according to the second embodiment of the present invention includes an amplification device 304*a* for amplifying an input voltage and providing the amplified voltage to the microprocessor 114 and condensers C1 and C2 connected in series with resistors R1 and R2 at the input and output terminals of the amplification device and feeding back the output voltage of the amplification device as an input voltage. The terminals (a,b), (c,d) and (e,f) of the coil unit 303 are parallely connected with the condensers C1 and C2, so that when the core 13 and the second sliding member 302 are moved in the vertical and horizontal directions in the inner space of the coil unit 303 and along the upper surface of the second support member 301, the waveform shaping unit 304 operates as a LC resonant circuit.

The operation of the water level and vibration detection apparatus for a washing machine according to the second embodiment of the present invention will be explained with reference to the accompanying drawings.

When a water is supplied into the washtub 101, the water pressure of the thusly supplied water is applied to the bellows 11 in the housing 200 of the water level and vibration sensor 300 via the water pressure transfer path 113 connected with the tank 100.

When the water pressure is increased, the pressure of the bellows is increased. When the bellows 11 is upwardly moved, the second sliding member 302 which is formed of a magnetic material and is positioned at the center position of the support member is vertically and upwardly moved in the inner space of the coil unit 303 onto which the coils 303*a* through 303*c* are wound in the X, Y and Z directions.

The inductance of the X direction coil 303*c* is varied at the coil unit 303 based on the vertical movement distance of the second support member 301 and the second sliding member 302. The inductance of the X and Y direction coil 303*a* and 303*b* are not varied.

As shown in FIG. 14, since the X and Y direction coils 303*a* and 303*b* are installed in the vertical direction, even when the core 13, the second support member 301 and the second sliding member 302 are moved in the vertical direction, the X and Y direction coils 303*a* and 303*b* do not receive any effects. Therefore, the inductance of the coils 303*a* and 303*b* do not vary.

However, since the Z direction coil 303*c* is installed in the horizontal direction, and the core 13, the second support member 301 and the second sliding member 302 are moved in the vertical direction in the inner space of the horizontally installed Z direction coil 303*c*, only the inductance of the Z direction coil 303*c* is varied.

As the core 13, the second support member 301 and the second sliding member 302 are upwardly moved in the inner space of the Z direction coil 303*c*, the inductance of the Z direction coil 303*c* is increased.

The inductance variation value of the Z direction coil 303*c* is multiplied by the capacitance C of the condensers C1 and C2 of the waveform shaping unit 304 as shown in FIG. 15 and is changed to a certain resonant frequency. The thusly obtained resonant frequency is fully amplified to its limit level by the amplification device 304*a* of the waveform shaping unit 304 and is supplied to the microprocessor 114.

Namely, both terminals a and b of the Z direction coil 303*c* are parallely connected between the condensers C1 and C2 of the waveform shaping unit 304, the waveform shaping unit 304 operates as a LC resonant circuit by the Z direction coil 303*c* and the condensers C1 and C2 for thereby generating a resonant frequency. Therefore, it is possible to measure the water level during the washing and rinsing processes using the thusly changed resonant frequency in the same manner as the first embodiment.

After the washing and rinsing processes are performed, the microprocessor 114 operates the inductance motor 103 at a high speed for thereby implementing a dehydration process.

At this time, if the laundry is uniformly provided in the walls of the washtub 101, the washtub 101 is uniformly rotated based on the same radius, so that any vibration of the tank 100 does not occur for thereby implementing a balanced rotation.

If the tank 100 is not vibrated in the balanced state, as shown in FIG. 10, the second sliding member 302 does not move in the leftward and rightward directions along the inclination surfaces 301*a* and 301*b* of the second support member 301, namely, in the −X and +X directions, and is positioned in the non-vibration area.

Since the second sliding member 302 is positioned in the non-vibration area of the second support member 301, and the core 13 is not vertically moved by the zero water level of the washtub during the dehydration process, the inductance of the X direction coil 303*a* is not varied.

If the second sliding member 302 is continuously positioned in the non-vibration area of the second support member 301 based on the balanced position of the laundry, the same resonant frequency is continuously generated from the LC resonant circuit.

The microprocessor 114 recognizes the balance state of the tank 100 based on the voltage wave form with respect to the same resonant frequency and accelerates the inductance motor 103 using the motor driving unit 115 during a set dehydration time for thereby implementing a dehydration process in the washtub 101.

However, if the laundry is non-uniformly provided at the wall of the washtub 101, the washtub 101 is eccentrically rotated, and the tank 100 is vibrated based on the degree of the eccentric rotation and is leaned in the direction of the eccentrically positioned laundry.

When the tank 100 is vibrated, the second sliding member 302 having a diameter of 3 mm through 5 mm slides along the inclination surfaces 301*a* and 301*b* from the upper surface of the second support member 301 at an angle range of zero trough 40° based on the degree of the vibration. Namely, the second sliding member 302 slides in the direction of the vibration area (±X directions).

As shown in FIG. 10, when a certain force (vibration) is applied from the right portion, the second sliding member 302 is moved in the rightward direction (±X) via the inclination surface 301*b* from the center portion (non-vibration area) of the second support member 301, namely, in the vertical direction (±Z) in the vibration area. On the contrary, if a certain force (vibration) is applied from the left portion, the second sliding member 302 is moved in the left direction (−X) via the inclination surface 301*a* from the center portion of the second support member 301, namely, in the vertical direction (±Z) in the vibration area.

As shown in FIG. 14, in a state that the X direction coil 303*a* is installed in the vertical direction, and the Z direction coil 303*c* is horizontally installed, the second sliding member 302 is moved in the horizontal and vertical directions (in the vibration area) along the inclination surfaces 301*a* and 301*b* of the second support member 301. As a result, the inductance of the X direction coil 303*a* and the Z direction coil 303*c* is changed.

In the second embodiment of the present invention, the diameter of the second sliding member 302 is about 4 mm, and the inclination angle of the inclination surfaces 301 and 301*b* is about 20°.

The variation value of the inductance of the X direction coil 303*a* and the Z direction coil 303*c* is changed to a resonant frequency based on the condensers C1 and C2 as shown in FIG. 15. Therefore, it is possible to obtain a X direction vibration by a certain function with respect to the X and Z direction inductance variations by the microprocessor 114 based on the thusly obtained variation value.

Assuming that the vibration in the X and Z directions are $V_X$ and $V_Z$, the X direction vibration $V_X$=f1 ($L_X$, $L_Z$) where f1 is a certain function.

If the X direction vibration occurs, the laundry soaking and dehydration processes are continuously performed.

In the second embodiment of the present invention, since the second support member 301 is formed on the inclination surfaces 301*a* and 301*b* (vibration area) at a certain angle in the ±X directions at the upper surface center portion (non-vibration area), the X direction coil 303*a* of the coil unit 303 is not used. Namely, a horizontally arranged cylindrical coil 14 as shown in FIG. 3 is additionally used for thereby computing the 경 direction vibrations.

Figure 3:
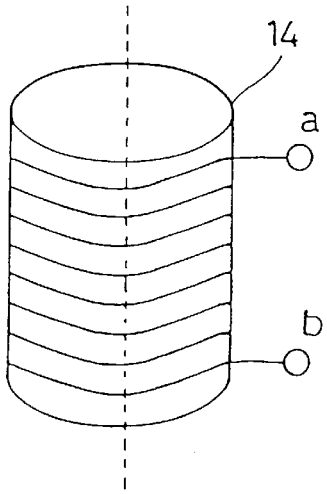
FIG. 3 illustrates an enlarged view of a coil provided to the water level sensor of FIG. 2.
Figure 4:
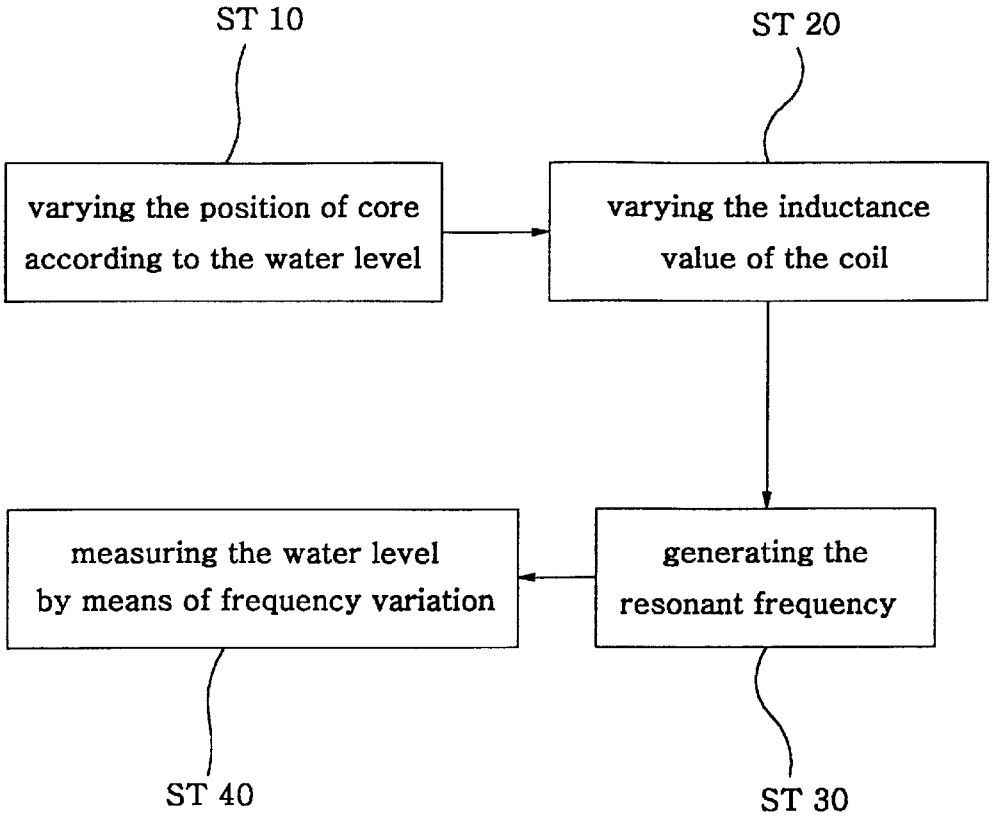
FIG. 4 is an exemplary view showing the principles for measuring the water level within the washtub through an amount of variation of the frequency of the water level sensor of FIG. 2.
Figure 5:
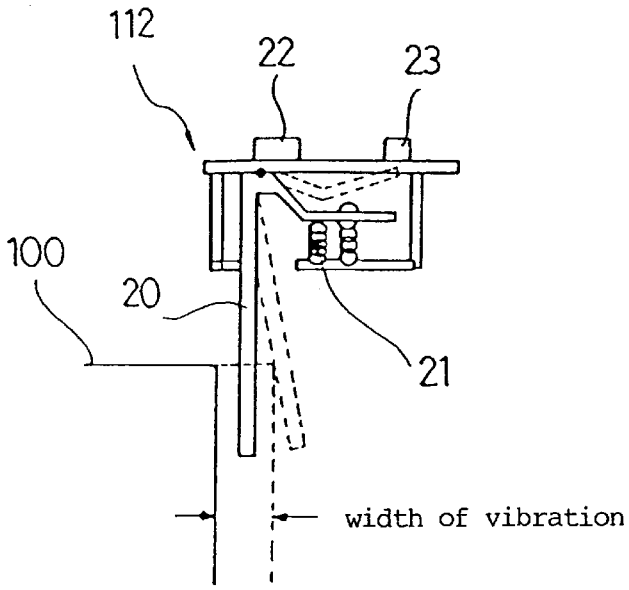
FIG. 5 illustrates a detailed side view of the vibration sensor in FIG. 1.

As shown in FIG. 3, when adapting the coil 14, the second sliding member 302 is moved in the vertical direction with respect to the horizontally installed coil based on the inclination angle of the inclination surfaces 301*a* and 301*b* of the second support member 301.

Figure 11:
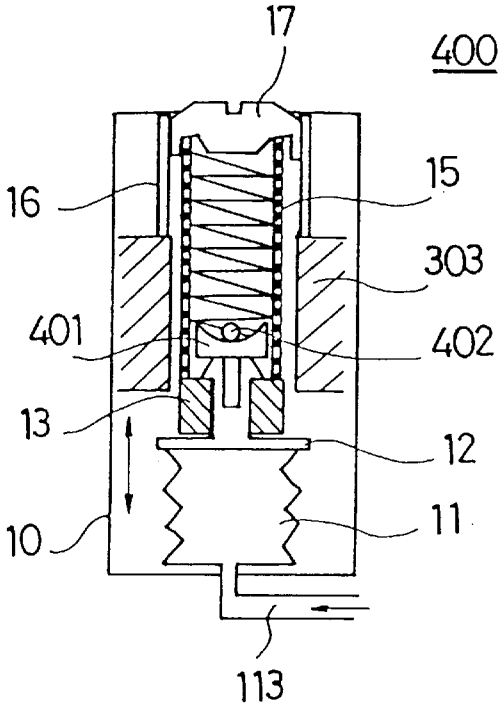
FIG. 11 illustrates a sectional view taken in a vertical direction of a unitary water level and vibration sensor in a washing machine according to a third embodiment of the present invention.
Figure 12:
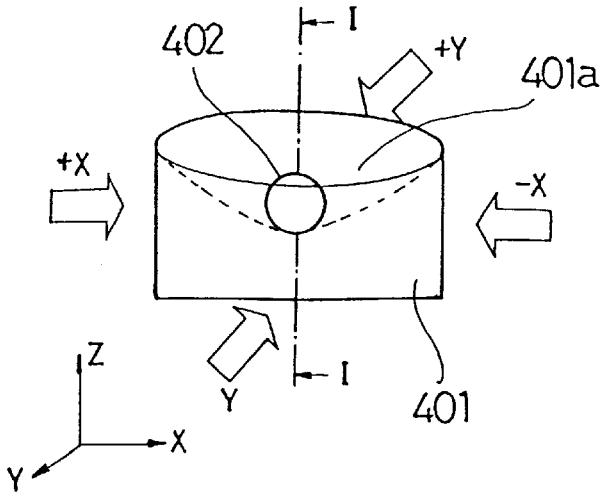
FIG. 12 illustrates an enlarged perspective view of a third support member of FIG. 11, in which a third sliding member moves freely along the inner rounded surface of the third support member according to the impact in every direction of the tank.

FIGS. 11 through 13 illustrate the third embodiment of the present invention.

FIG. 11 is a vertical cross-sectional view illustrating a water level and vibration sensing apparatus according to a second embodiment of the present invention, and FIG. 12 is a perspective view illustrating the third support member of FIG. 11, and FIG. 13 is a cross-sectional view taken along the line I—I of FIG. 12.

The third support member 401 of the water level and vibration sensor 400 according to the third embodiment of the present invention includes a three dimensional spherical shape rounded surface having its upper surface which is radially rounded from its center portion for thereby implementing a radial direction free movement of the third sliding member 402 and is directed to detecting the vibrations in the forward and backward directions and the upward and downward directions.

In this case, the Z direction coil unit 303 is capable of detecting the movement of the core 13 based on the water level of the washtub during the washing process and is capable of measuring the water level and the upward and downward direction vibrations of the third sliding member 402.

In view of the ±Z direction movements, there are two types of the movements. Namely, the third sliding member 402 formed of a magnetic material is moved in the upward and downward directions at the third support member 401, and the third sliding member 402 is moved based on an inclination angle at the rounded surface 401*a* of the third support member 401.

Continuously, the X and Y direction coils 303*a* and 303*b* are capable of measuring the current position of the third sliding member 402 which is moved in the forward and backward directions at the rounded surface 401*a* of the third sliding surface 401 in two dimension.

Therefore, it is possible to measure the X, Y and Z direction vibrations by measuring the X and Y direction vibrations in the above-described manner.

At this time, assuming that the inductances of the X, Y and Z direction coils 303*a* through 303*c* measured in the X, Y and Z directions are $L_X$, $L_Y$, $L_Z$, the expression of $V_X$=f1 ($L_X$, $L_Z$), $V_Y$=f2 ($L_Y$, $L_Z$), and $V_Z$=f3 ($V_Z$). Here, f1 through f3 are certain function.

FIG. 16 illustrates the fourth embodiment of the present invention.

In the fourth embodiment of the present invention, the vibrations in the washing machine are detected using only the water level sensor 111 without the support members 201, 301 and 401 and the sliding members 202, 302 and 402.

Figure 2:
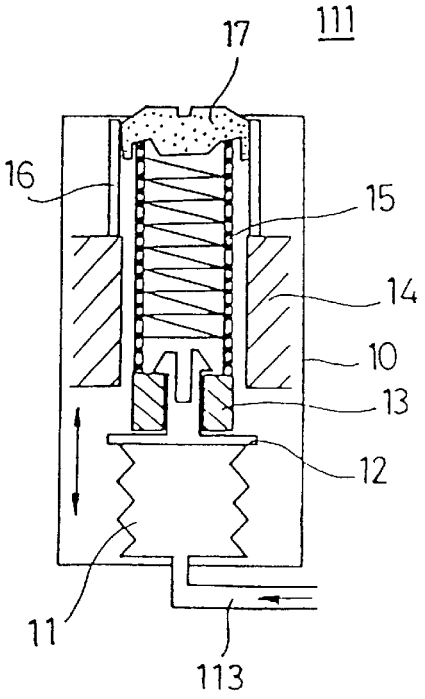
FIG. 2 illustrates an enlarged sectional view taken in a vertical direction of the water level sensor in FIG. 1.
Figure 16A:
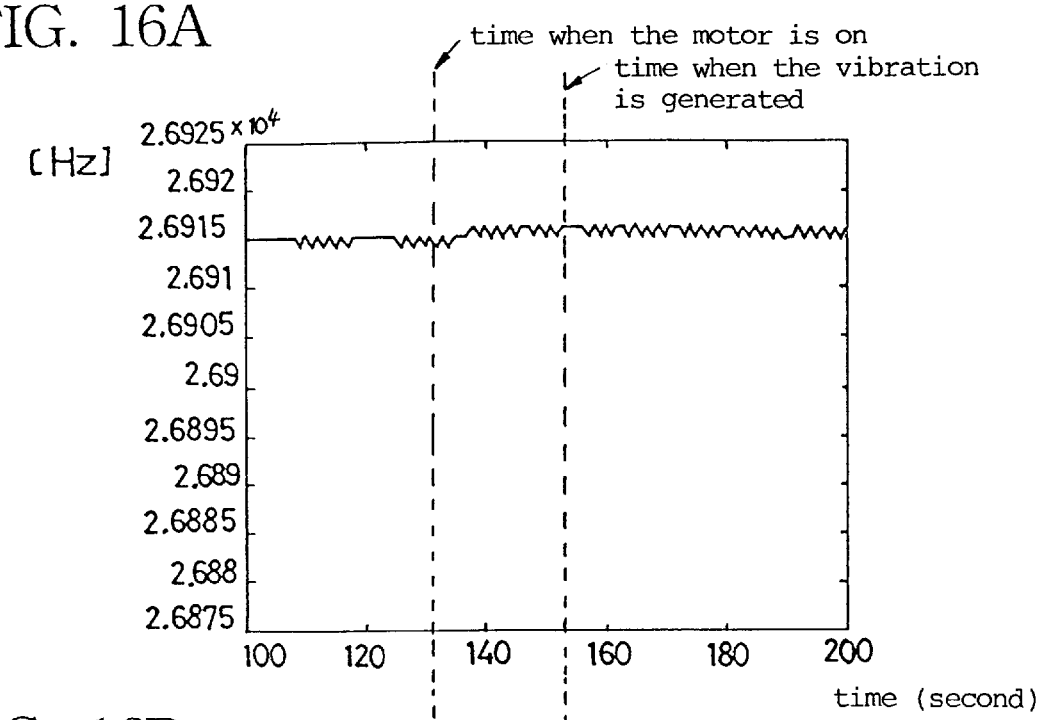
Figure 16B:
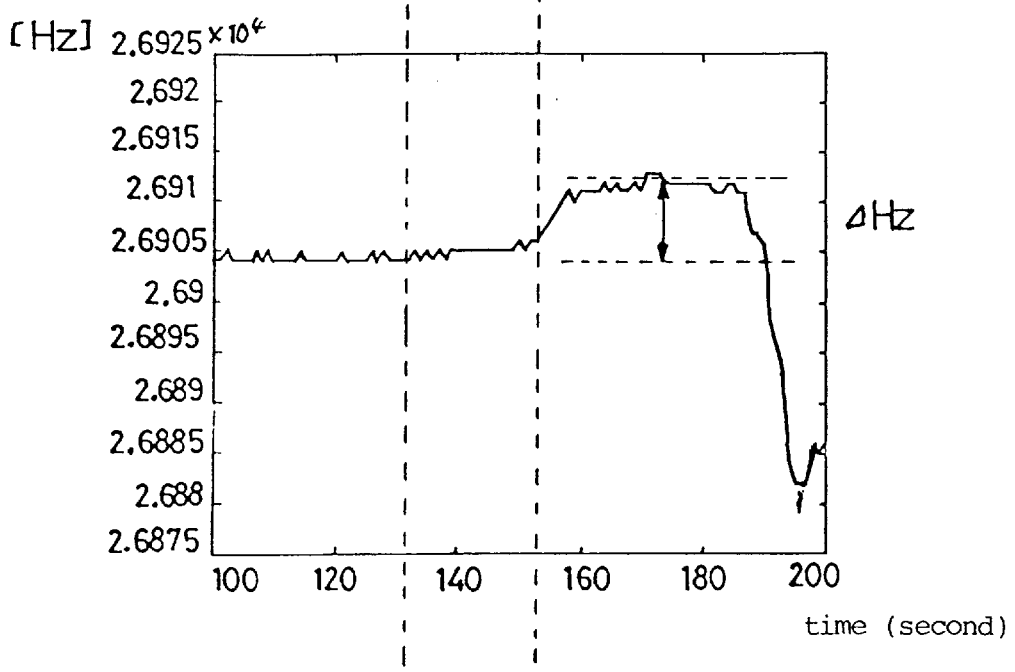

FIG. 16 illustrates the water level and vibration detection method according to the fourth embodiment of the present invention based on FIGS. 2, 3 and 6. FIG. 16A is a resonant frequence wave form measured based on the water level sensor at the time when the dehydration process is performed in the non-eccentric process, and FIG. 16B is a resonant frequence wave form measured based on the water level sensor at the time when the dehydration process is started in the eccentric process. As shown in FIG. 16A, in the case that there is not eccentricity in the laundry or in the case of the non-load dehydration process, the induction motor 103 is driven in the zero water level state, and even when the speed of the induction motor 104 is increased based on the time lapse, the washtub 101 is not eccentrically rotated. Therefore, the resonant frequency of the water level sensor 111 is not changed.

However, as shown in FIG. 16B, in the case that there is a great eccentricity at the laundry, as the speed of the induction motor 103 is increased, the eccentric rotation of the washtub 101 is increased. The thusly increased eccentric rotation operates as an impact force which is applied to the outer casing 102, and the thusly applied impact force is detected by the water level sensor 111. The core 13 of the water level sensor 111 is moved in the interior of the coil 14 in the vertical direction based on the impact degree of the outer casing 102, so that the inductance of the coil 14 is changed. The thusly changed inductance is changed to a resonant frequency by the LC resonant circuit, so that it is possible to measure the vibration by measuring the thusly changed resonant frequency. Namely, as shown in FIG. 16B, in the case that there is a great eccentricity at the laundry, the variation ΔHz of the resonant frequency of the water level sensor 111 is increased. Therefore, it is possible to check the current dehydration vibration state by detecting the variation ΔHz of the resonant frequency.

In more detail, the changed water pressure based on the water level of the washtub 101 is changed to the resonant frequency variation. In the case that the water level of the washtub 101 is a zero level checked by the water level sensor 111, and there is not water to be dehydrated, the resonant frequency H1 is measured and is set in the microprocessor 114 as a reference resonant frequency.

Thereafter, it is confirmed whether the current washing operation is a dehydration process. If the current mode is the dehydration mode, the resonant frequency H2 is measured in the case that the water level is a zero level measured by the water level sensor 111, and there is water to be dehydrated for thereby obtaining deviations H2-H1 based on the reference resonant frequency H1. The thusly obtained deviation is compared with the reference variation ΔH. If the deviation is smaller than the reference variation ΔH, the induction motor 103 is rotated at a high speed for thereby implementing a normal dehydration. However, if the thusly obtained deviation is larger than the reference variation ΔH, the driving operation of the induction motor 103 is stopped, and the dehydration process is temporarily stopped, so that the over vibration of the washtub 101 is prevented.

The reference variation ΔH is a value which is previously set with respect to the values which are obtained based on a characteristic such as a type, capacitance, standard, etc. of the washing machine. In the dehydration process of the fourth embodiment of the present invention, the case that the vibrations are detected was explained. In another embodiment of the present invention, in the case that the induction motor 103 is in the turned on mode, it is possible to detect an over vibration during the entire washing processes by measuring the frequency variation using the water level sensor 111.

In the present invention, it is possible to detect the vibrations of the washing machine based on the water level of the washtub and the rotation of the washtub using the water level and vibration sensor in the washing and dehydration modes compared to the conventional art in which the water level of the washtub is detected using the water level sensor and LC resonant circuit in the washing process, and the vibration of the washing machine is detected using a mechanical vibration sensor such as a limit switch in the dehydration mode.

As a result, in the present invention, it is possible to accurately measure the vibration of the washing machine based on the water level of the washtub and the eccentric rotation of the washtub, so that the error of the vibration detection and the time for dehydration are decreased. In addition, the number of the mechanical elements is decreased.

As described above, in the present invention, the vibration of the washing machine due to the eccentricity of the laundary and the water level are more accurately measured for thereby preventing the energy increase due to the vibration detection error and the increased dehydration time in the conventional art.

In the present invention, the water level and vibrations are accurately detected based on a quick operational response of the sliding member and coils in accordance with the eccentric degree of the laundry, so that it is possible to implement a better washing and dehydration process compared to the conventional washing machine. In addition, the reliability of the product is enhanced by implementing a performance stabilization of the product.

In the water level and vibration detection apparatus for a washing machine according to the present invention, the water level of the washtub and the vibration of the washing machine are accurately detected by a unitary sensor or a water level sensor, so that the mechanical vibration detection limit switch is not used for thereby implementing a cost reduction and preventing a complicate structure.

In addition, in the present invention, it is possible to implement a three dimensional vibration measurement. If the vibration width of the washing machine is large, it is possible to implement a simple control for stopping the washing and dehydration processes, and an active operation which is directed to detecting the vibration state during the washing and dehydration processes.

Although the preferred embodiment of the present invention have been disclosed for illustrative purposes, those skilled in the art will appreciate that various modifications, additions and substitutions are possible, without departing from the scope and spirit of the invention as recited in the accompanying claims.

What is claimed is:

1. A water level and vibration detection method for a washing machine, comprising the steps of:

measuring a resonant frequency when a water level of a washtub is zero, and there is not a laundry in the washtub in a water level sensor which is directed to changing a water pressure variation based on a water level of a washtub into a resonant frequency for thereby detecting a water level of the washtub;

setting the resonant frequency as a reference resonant frequency;

measuring a resonant frequency using the water level sensor in the dehydration mode among the washing operation and obtaining a deviation with respect to the reference resonant frequency; and determining whether a dehydration process is performed based on a comparison between the deviation of the resonant frequency and the reference deviation.

2. A water level and vibration detection method for a washing machine, comprising the steps of:

measuring a resonant frequency when a water level of a washtub is zero, and there is not a laundry in the washtub in a water level sensor which is directed to changing a water pressure variation based on a water level of a washtub into a resonant frequency for thereby detecting a water level of the washtub;

setting the resonant frequency as a reference resonant frequency;

checking whether an induction motor is operated for rotating the washtub;

measuring a resonant frequency based on the water level sensor when the induction motor is in the operation mode and obtaining a deviation with respect to the reference resonant frequency; and determining whether the induction motor is continuously operated based on a comparison between the thusly obtained deviation and a set reference deviation.

3. A water level and vibration detection method for a washing machine, comprising the steps of:

changing an induction of a coil based on a movement in an inner space of a coil by a variation of a water pressure in accordance with a water level of a washtub in the washing mode;

changing the induction of the coil based on a movement in an inner space of the coil by a variation in the horizontal and vertical directions in accordance with an eccentric rotation of the washtub in the dehydration mode;

changing a resonant frequency by adding a set capacitance value to a varied value of the inductance which is obtained based on the operational modes; and controlling a washing operation by judging the water level and vibration based on the variation of the resonant frequency obtained in the operation modes.

4. The method of claim 3, wherein assuming that the inductance variation of the coil based on the water level of the washtub is $\Delta L1$ in the washing mode, and the inductance variation of the coil based on the vibration of the washtub is $\Delta L2$, the variation of the inductance is $\Delta L1 > \Delta L2$.

5. A water level and vibration detection method for a washing machine, comprising the steps of:

changing an inductance value based on a movement in an inner space of a coil unit having more than at least two inductances based on a variation of a water pressure in accordance with a water level of a washtub;

changing more than at least one inductance including an inductance with respect to the vertical direction at the coil unit as a sliding member is freely moved with respect to a support member in which there are a vibration area and a non-vibration area in accordance with an eccentric rotation of the washtub;

adding a certain capacitance to the varied inductance and changing to a resonant frequency; and controlling the operation modes of the washing operation by judging the water level or vibration using a varied value of the resonant frequency in accordance with the washing operation.

6. The method of claim 5, wherein assuming that the leftward and rightward directions are X, the forward and backward directions are Y, and the upward and downward directions are Z with respect to the co-axis of the washtub, the coil unit has an inductance with respect to the X, Y, and Z directions.

7. The method of claim 6, wherein among the X, Y and Z directions of the coil unit, one direction is determined as a water level detection direction, and one direction and the remaining two directions are determined as a vibration detection direction.

8. The method of claim 5, wherein assuming that the vibrations in the X, Y, and Z directions of the coil units are $V_X$, $V_Y$, and $V_Z$, and the inductances of each direction are $L_X$, $L_Y$, and $L_Z$, the vibration measurement with respect to each direction is performed based on the following equations:

$$V_X = f1\ (L_X, L_Z)$$

$$V_Y = f2\ (L_Y, L_Z)$$

$$V_Z = f3\ (V_Z)$$

where f1, f2 and f3 are certain function.

9. A water level and vibration detection apparatus for a washing machine, comprising:

a sealing state maintaining means which is installed in a housing connected with a tank and a water pressure transfer path and is vertically moved based on a water pressure in accordance with a water level of a washtub;

a coil having an inductance and installed at an inner center wall portion of the housing;

a magnetic medium engaged to an upper surface of the sealing state maintaining means and vertically moving in an inner space of the coil in accordance with the water pressure and varying the inductance;

a support member positioned in an inner space of the coil at a certain distance from the upper portion of the magnetic medium and vertically moving together with the magnetic medium by the water pressure and having its upper surface which is slanted at a certain angle;

a sliding member having a certain diameter, vertically moving along an inclination surface based on an eccentric rotation of the washtub and varying the inductance of the coil; and a waveform shaping means for adding a certain capacitance to a variation value of the inductance of the coil, generating a resonant frequency, stabilizing the resonant frequency to a voltage waveform and selectively measuring the water level and eccentricity.

10. The apparatus of claim 9, wherein said inclination surface of the support member has an inclination angle from 0(zero) to 40° in the direction of the co-axis of the washtub.

11. The apparatus of claim 10, wherein an inclination angle of the support member is about 20°.

12. The apparatus of claim 9, wherein the height from the bottom surface of the support member to the initial point of the inclination angle is about 0 mm through 2 mm.

13. The apparatus of claim 9, wherein the diameter of the sliding member is 3 mm through 5 mm.

14. The apparatus of claim 13, wherein the diameter of the sliding member is about 4 mm.

15. The apparatus of claim 9, wherein said sliding member is formed of a magnetic material.

16. The apparatus of claim 9, wherein said sliding member is formed of a stainless material when the inclination angle of the support member is 0°, and the diameter of the sliding member is 4 mm.

17. The apparatus of claim 9, wherein said waveform shaping means includes:

an amplification device for amplifying and outputting an input voltage; and a condenser connected in series with each resistor at an input and output terminal of the amplification device for feeding back an output voltage of the amplification device to an input terminal, whereby the waveform shaping means operates as a LC resonant circuit by a vertical movement of the sliding member by parallely connecting the coil to the condenser.

18. A water level and vibration detection apparatus for a washing machine, comprising:

a sealing state maintaining means installed in a housing connected with a tank and a water pressure transfer path and expanding by a water pressure based on the water level in a washtub and vertically moving;

a coil unit having more than at least two inductances and installed at an inner center wall portion of the housing;

a magnetic medium engaged to an upper surface of the sealing state maintaining means and vertically moving in an inner space of the coil unit based on the water pressure and changing a certain inductance;

a support member installed in an inner space of the coil unit at a certain distance from the upper portion of the magnetic medium and vertically moving in the inner space of the coil unit together with the magnetic medium by the water pressure and having its upper surface formed at an inclination angle with respect to the center portion;

a sliding member having a certain diameter, freely moving along an inclination surface of the support member based on an eccentric rotation of the washtub and varying one inductance at the coil unit; and a waveform shaping means for adding a fixed capacitance to an inductance variation of the coil unit, generating a resonant frequency, stabilizing the resonant frequency to a voltage waveform, and selectively measuring the water level and the vibration in each direction.

19. The apparatus of claim 18, wherein assuming that the leftward and rightward directions are X, the forward and backward directions are Y, and upward and downward directions are Z in the vibration direction with respect to the co-axis of the washtub, the coil unit has a cubic shape and is wound at a certain winding ration in the X, Y and Z directions.

20. The apparatus of claim 19, wherein a coil among the X, Y and Z direction coils is directed to varying the inductance based on the water pressure and vibrations, and the remaining two coils are directed to varying the inductance based on the vibrations based on an eccentric rotation of the washtub together with the coil for thereby measuring the vibrations in each direction.

21. The apparatus of claim 18, wherein an upper surface of the support member is formed at the same inclination angle in the leftward and rightward directions from its center portion for thereby detecting a 경 directions based on the eccentric rotation of the washtub.

22. The apparatus of claim 21, wherein two inclination surfaces of the support member has an inclination angle range from 0(zero) to 40° in two directions with respect to the co-axis of the washtub.

23. The apparatus of claim 22, wherein said two inclination angles of the support member is about 20°.

24. The apparatus of claim 18, wherein when an upper surface of the support member has an inclination shape at the same angle in both directions from its center portion, the X direction coil operates as a cylindrical shape single coil unit.

25. The apparatus of claim 18, wherein the diameter of the sliding member is 3 mm through 5 mm.

26. The apparatus of claim 25, wherein the diameter of the sliding member is about 4 mm.

27. The apparatus of claim 18, wherein an upper surface of the support member is rounded to have an inclination in the radial direction from its center portion and has a spherical rounded portion so that the sliding member freely moves in the radial direction.

28. The apparatus of claim 27, wherein an inner rounded surface of the support member has a rounding angle of 0° through 40° from its center portion.

29. The apparatus of claim 28, wherein an inclination angle of an inner rounded surface of the support member is 20°.

30. The apparatus of claim 18, wherein said waveform shaping means includes:

an amplification device for amplifying and outputting an input voltage; and a condenser connected in series with each resistor at an input and output terminal of the amplification device for feeding back an output voltage of the amplification device to an input terminal, whereby the waveform shaping means operates as a LC resonant circuit when the sliding member is moved along the support member by parallely connecting the coil to the condenser.

31. The apparatus of claim 18, wherein said sealing state maintaining means includes a bellows which is engaged with the water pressure transfer path in the housing and is expanded in the vertical direction based on the water pressure in accordance with the water level.

* * * * *